United States Patent [19]

Nishizawa et al.

[11] 4,070,498

[45] Jan. 24, 1978

[54] METHOD OF MANUFACTURING FLUORESCENT SCREEN OF COLOR PICTURE TUBE

[75] Inventors: Masahiro Nishizawa; Takehiko Ueyama, both of Mobara, Japan

[73] Assignee: Hitachi, Ltd., Japan

[21] Appl. No.: 710,304

[22] Filed: July 30, 1976

[30] Foreign Application Priority Data

Oct. 1, 1975 Japan ..... 50-117691

[51] Int. Cl.[2] ..... B05D 3/06; B05D 5/06

[52] U.S. Cl. ..... 427/53; 427/54; 427/68; 96/36.1

[58] Field of Search ..... 427/68, 82, 53, 54; 96/36.1

[56] References Cited

U.S. PATENT DOCUMENTS

| | | | |
|---|---|---|---|
| 3,779,760 | 12/1973 | Miyaoka | 96/36.1 |
| 3,936,302 | 2/1976 | Fukuda | 427/68 |
| 3,993,487 | 11/1976 | Hosokoski | 96/36.1 |

*Primary Examiner*—Ralph S. Kendall
*Assistant Examiner*—R. Eugene Varndell, Jr.
*Attorney, Agent, or Firm*—Craig & Antonelli

[57] ABSTRACT

A method for manufacturing a fluorescent screen of a color picture tube by the steps of forming a coating of opto-hardening material on the inner surface of the faceplate of the panel of a color picture tube and exposing to a light and hardening selectively the coating thereby to form a matrix of stripes of the opto-hardening material, in which the selective exposure is performed by projecting a light derived from a light source having a predetermined width from each of at least two positions which are separated from the inner surface of the faceplate by a predetermined distance and also separated from each other onto the coating of the opto-hardening material formed on the faceplate through a slot of a predetermined width of a mask located between the inner surface of the faceplate and the light source, whereby the width of the stripe changes little even when the luminous intensity of the light source changes.

2 Claims, 4 Drawing Figures

METHOD OF MANUFACTURING FLUORESCENT SCREEN OF COLOR PICTURE TUBE

This invention relates to a manufacturing method of the fluorescent screen of a color tube and more particularly to that of the fluorescent screen of a negative stripe type in which phosphors are arranged in a number of stripes each stripe having a width narrower than that of each slot formed in the shadow mask incorporated to the cathode-ray tube.

One of widely used color tubes is of a so-called black stripe type in which black material fills the spaces between adjacent stripes of phosphors of primary colors and which belongs to the above-mentioned type of color picture tube. In the manufacture of this type of color picture tube the inner surface of the faceplate of the panel of the color picture tube is first uniformly coated with photoresist. Next, the photoresist coatings on the portions where phosphor stripes of three colors of green, blue and red are formed are sequentially and selectively exposed to a light for hardening. Following this, the faceplate is washed out with water for removing parts of the photoresist not exposed to the light, resulting in the formation of a matrix of stripes of photoresist. After this, black material is applied over the entire surface of the faceplate and processed with hydrogen peroxide or the like thereby to remove the remaining parts of the photoresist, whereby the black material coated on the portions where the photoresist has been previously removed remains, while the black material coated on the stripes of the photoresist is removed together with the photoresist coating, with the result that a matrix of stripes of the black material is formed. The spaces between the stripes of the black material where no black material exists are generally called "windows". Next, coating of phosphors of green, blue and red are applied to the respective windows thereby to form a matrix of stripes of green, blue and red phosphors arranged in a predetermined order. Each of the phosphor stripes covers one window and extends at both longitudinal edges thereof over the respective edges of the stripes of the black material which define the window. For example, in forming the stripes of green phosphor, a mixture of green phosphor and photoresist is coated over the entire surface of the face plate where the stripes of black material have been formed, and then only the portions of the coating of the mixture where the stripes of green phosphor are to be formed are selectively exposed to a light for hardening through a mask and then the remaining portions which are not exposed to the light are removed. In this way, the respective matrix stripes of green, blue and red phosphors are formed successively thereby to complete the fluorescent screen. The actual width of each of the stripes of color phosphors is slightly wider than the width of the window, but only a part of the phosphor stripe coated inside the window is effective to reproduce a visible color image. Therefore, the effective width of the stripe of color phosphor is determined by the width of the window.

In the case of the fluorescent screen of the negative stripe type, the width of each phosphor stripe is so designed as to be narrower than that of each slot formed in the shadowmask to be combined with the screen, i.e. more precisely narrower than that of each light profile of the electron beam projected onto the fluorescent screen through each of the slots of the shadow mask.

For this purpose, when the portions of the photoresist coating where the windows, on which the phosphor stripes are to be coated, are exposed to light for hardening through the mask at the above-mentioned steps, the width of the profile of the light beam projected onto the photoresist coating through the slots of the mask and the energy of the projected light beam are controlled to form the windows each having a predetermined width. Hitherto, the exposure has been performed in such a manner that a light source having a predetermined width is located at a predetermined position and a light of the light source is projected onto the photoresist coating through each slot of the mask. This method, however, suffers from a drawback that when the light intensity from the light source changes due to the change of the power source voltage the light energy level applied to the photoresist coating greatly changes. Therefore, it is difficult to form the windows each having a predetermined width.

Accordingly, an object of the present invention is to provide an exposure method which is free from the drawbacks of the prior art and in which the width of the windows changes little even if the intensity of the light emitted from a light source changes due to the voltage change of a power source.

According to the present invention, there is provided a method for manufacturing a fluorescent screen of a color picture tube by the steps of forming a coating of opto-hardening material on the inner surface of the faceplate of the panel of a color picture tube and exposing selectively the coating to a light for hardening thereby to form a matrix of stripes of opto-hardening material, in which the selective exposure is performed by projecting a light derived from a light source having a predetermined length and located at each of at least two positions which are separated from the inner surface of the faceplate by a predetermined distance and are separated from each other, onto the coating of opto-hardening material formed on the faceplate through a slot of a predetermined width of a shadow mask located between the inner surface of the faceplate and the light source.

Other objects and features of the invention will be apparent from the following description in connection with the accompanying drawings, in which.

Figure 1:
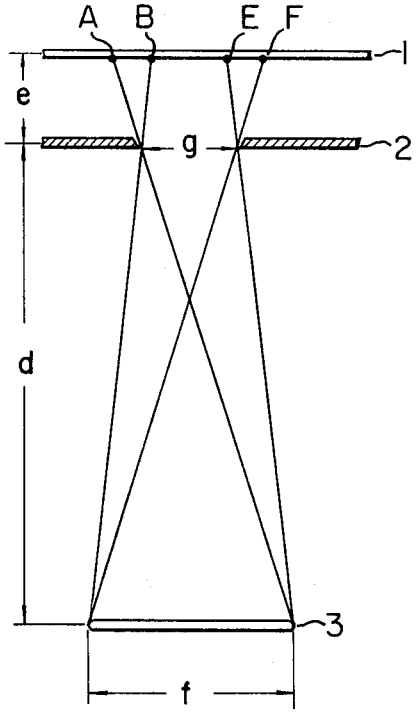
FIG.1 PRIOR ART
FIG. 1 is a schematic diagram showing the state of exposure according to a prior art method.
Figure 2:
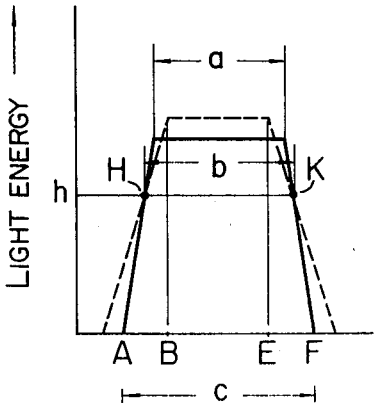
FIG.2 PRIOR ART
FIG. 2 is a diagram showing a distribution of light energy in the exposure shown in FIG. 1.

Reference is now made to FIG. 1 in which a power source 3 with a width $f$, a shadow mask 2 with a slot having a width $g$ and a faceplate 1 are arranged in parallel to one another with a predetermined distance $e$ between the inner surface of the faceplate and the shadow mask 2, and a predetermined distance $d$ between the light source 3 and the shadow mask 2. When the light beam originating from the light source having a width $f$ is projected through a slot of width $g$ onto the faceplate 1, it produces thereon a light profile having a width $\overline{AF} = c$, as shown in FIG. 1. However, the light from the full width of the light source projects onto only the central portion $\overline{BE} = a$, and the light from a part of the light source width does not project onto the portions $\overline{AB}$ and $\overline{EF}$ at both the sides thereof. FIG. 2 shows a distribution of the light energy on the light profile when the light beam is projected thereonto for a predetermined time period under the condition of FIG. 1. The hardening of photoresist by a light exposure requires a light energy above a predetermined level, although such a light energy level depends on the kind of photoresist to be used. Assume that the light energy level in this example is $h$. The photoresist hardens only at the portion $\overline{HK}$ in the graph. If the desired width of the window is $b$, the width $f$ and the intensity of the light is selected so as to provide the relation $\overline{HK} = b$. In this example, the maximum width of the light profile $\overline{AF} = c$ and the central portion $\overline{BE} = a$ which receives the light from the full width of the light source are respectively given by the equations $$a = (1 + \frac{e}{d})g - (\frac{e}{d}) \times f$$
$$c = (1 + \frac{e}{d})g + (\frac{e}{d}) \times f$$

In order to make change of the stripe width $b$ small even when the luminous intensity of the light source changes, the inclination of the light energy distribution curve must be steep at both sides of the light profile. This inclination changes depending on the width of the light source. For example, in the case of using a large width of the light source, the projected light energy must be distributed as depicted by the dotted line in FIG. 2, in order to obtain a predetermined width $b$ of the window. However, such an energy distribution is not preferable because the inclination of the energy level distribution curve is not sharp around the portions where the energy level is $h$. A preferable energy distribution is such that on the one hand the inclination is steep at the portions which receive only light derived from a part of the light source width, and on the other hand the projected light energy level at the portion of the light profile corresponding to the desired width of the window to be made is as low as possible relative to the light energy level at the portion which receives the light derived from the full width of the light source. In the conventional method, the light source width $f$ is selected to be optimum, so as to satisfy the requirements mentioned above. However, the conventional method can hardly achieve a satisfactorily sharp inclination. Thus, the amount of change of the window width $b$ ranges from 7% to 10% with 10% change of the intensity of exposure light. This needs a strict control of the intensity of exposure light.

Figure 3:
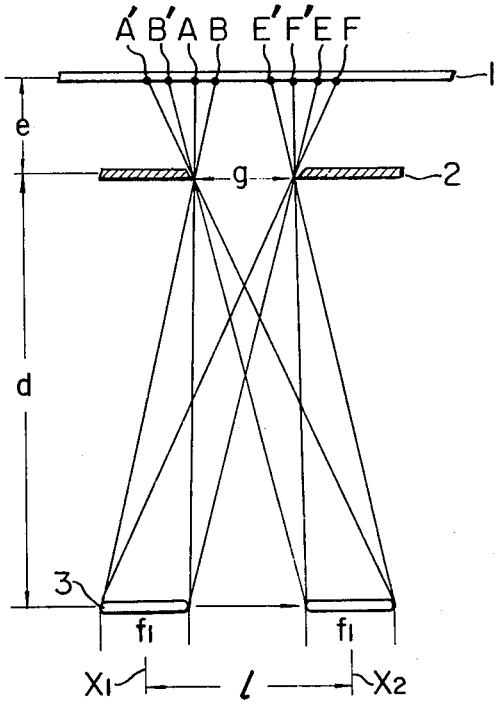
FIG. 3 is a schematic diagram showing the state of exposure according to the present invention.

An exposure method according to the invention will be described with reference to FIG. 3, in which like symbols are used to designate like parts or portions with those of FIG. 1.

As will be seen from the drawings, in the exposure method according to the invention, a light source with a relatively short width $f_1$ is located at a position $x_1$ and illuminates the faceplate 1 through a slot with its width $g$ of the shadowmask 2. Then, the light source 3 is moved by a distance $l$ to be relocated at a position $x_2$. During this movement, the light from the light source is extinguished or shielded by using a suitable shielding means (not shown) for preventing the exposure of the faceplate. The subsequent exposure of the faceplate is performed through the illumination of the same light source relocated at the position $x_2$. Such an exposure produces a light energy distribution P which is the sum of an energy distribution $P_1$ given by the light source positioned at $x_1$ and another energy distribution $P_2$ given by the light source positioned at $x_2$. In this case, the luminous intensity, the exposure time and the positions $x_1$ and $x_2$ of the light source 3 are so selected that the width $\overline{HK}$ corresponding to the light energy level $h$ becomes the width $b$. Thus, according to the invention, the exposure is performed by using a light source with a shorter width than that of the light source of FIG. 1. This means that the inclination of the energy distribution curve is steep at both sides of the light profile. Therefore, the exposure method of this invention can restrict to a sufficiently small value the change of the window width $b$ due to the change of the light intensity.

Figure 4:
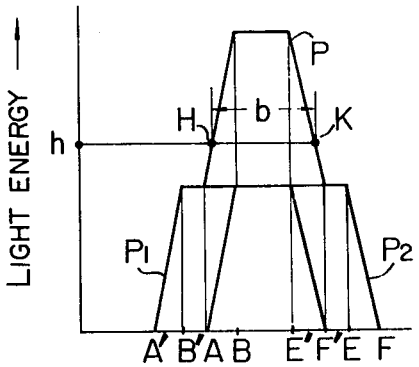
FIG. 4 is a diagram showing a distribution of light energy in the exposure shown in FIG. 3.

Next, an embodiment of the invention will be explained in comparison with the conventional method. In a black matrix type color picture tube of a size of 20 inches and deflection angle of 90° the dimensions measured at the central part of the tube, are $d = 265$ mm, $e = 17$ mm, slot width $g = 219\ \mu$, and stripe width $= 175\ \mu$. When the faceplate is exposed to a light from a rectangular light source with 2 mm width in accordance with the conventional exposure method, the projected light energy obtained at a portion corresponding to the desired stripe width is 72% of the maximum light energy at the central portion of the light profile, and the stripe width $b$ changes 19 $\mu$ when the illumination intensity of the light source changes 10%. On the contrary, in the exposure method of this invention with the use of a rectangular light source with its width 0.8 mm, the exposure of the faceplate is performed by locating the light source successively at the respective positions laterally distanced 0.6 mm from the center. The light energy distribution of the profile on the inner face of the faceplate formed by the exposure is shown in FIG. 4. In this exposure method, the projected light energy level at a portion corresponding to the desired stripe width is 64% of that at the central portion. The change of the stripe width $b$ is 11 $\mu$ when the illumination intensity changes 10%. Theoretically, since the invention is capable of reducing the change of stripe width to substantially zero with variation of the light intensity by 50% by using an ideal light source, i.e. line light source, thereby to make the light profile ideal.

While, in the embodiment heretofore described, the light source is moved once, the movement of the light source may be repeated. It will be noted that, in the respective light projecting positions for exposure, the durations and illumination intensities of exposure must be equal so as to provide the same effect on hardening the photoresist. However, the projection of the light must be interrupted during its movement from one to another position. If the light were projected continuously during the movement, it would result in the same effect as if a light source having a wider length were used according to the prior method as shown in FIG. 1.

An exposure method is well known in which a ring light source or a rotating light source is used for forming matrix holes (circular holes) each having a smaller diameter than that of each hole of the shadow mask when the fluorescent screen of the dot type color picture tube is exposed. In this exposure method, if the lights from the two points located symmetrical with respect to the center of the ring light source or the center of gyration of the light source were used for exposure, they would form a light profile having a projection light energy distribution as shown in FIG. 4. In fact, however, the lights emitted from the points other than those symmetrical two points prevents the formation of the stepwise distribution curve of the projected light energy as shown in FIG. 2. On the other hand, in the present invention, the lights are originated from at least two positions spaced from each other. Accordingly, if the light source width and the distance between the light projecting positions are appropriately selected, the light energy distribution exhibits a stepwise configuration. As a result, the exposure method of this invention has excellent effects which are far beyond those attained by the exposure method using the ring or rotating light sources for exposure of the dot type fluorescent screen.

In the foregoing description of the embodiment, the light shielding means is used for shielding the light during the light source movement. Alternately, other suitable ways, for example, directly turning off the power source to the light source may be employed for light shielding.

Moreover, in the example heretofore described, the exposures to light from the respective light projecting positions $x_1$ and $x_2$ are performed by moving a single light source. However, this may be substituted by other exposure methods, for example, a method using different light sources located at the positions $x_1$ and $x_2$ and other suitable positions. As the exposure position increases in number, the slope of the projected light energy distribution of the light profile becomes gentle. Accordingly, the most preferable number of the exposure positions is two.

Although the example heretofore described is the case for forming the matrix stripe of black material, the matrix stripe of phosphor may also be formed by the exposure method of this invention. Further, the exposure method of this invention also is applicable to the forming of the matrix stripe of the slot type.

What we claim is:

1. A method for manufacturing the fluorescent screen of a color picture tube including the steps of forming a coating of opto-hardening material on the inner surface of the faceplate of the panel of a color picture tube and exposing to a light and hardening selectively the coating thereby to form a matrix of stripes of opto-hardening material, in which said selective exposure is performed by projecting a light derived from a light source having a predetermined width from each of at least two positions onto said coating of opto-hardening material formed on said faceplate through a slot with a predetermined width of a shadow mask located between said inner surface of said faceplate and said positions whereby the inclination of the energy level distribution curve of said projected light is steep around the portion where the energy level is equal to that required to harden said coating, said positions being separated from said inner surface of said faceplate by a predetermined distance and spaced from each other in a direction parallel to the width of said slot and by a distance selected so that the light-exposed area on said coating obtained by light projection from said light source located at one of said positions overlaps with the light-exposed area obtained by light projection from said light source located at the other position, and selecting a light energy of said projected light such that the coating is hardened at only an area where the light projections from all of said positions are applied.

2. A manufacturing method of the fluorescent screen of a color picture tube according to claim 1, in which said light source having a predetermined width is located at one of said two positions and projects the light beam onto the coating of opto-hardening material through said slot and then said light source is moved to the other position and projects the light beam onto the same coating through the same slot, while the projection of the light beam is interrupted during the movement of said light source.

* * * * *